US006184839B1

(12) United States Patent
Butscher et al.

(10) Patent No.: US 6,184,839 B1
(45) Date of Patent: Feb. 6, 2001

(54) LARGE INSTANTANEOUS BANDWIDTH REFLECTOR ARRAY

(75) Inventors: Frank D. Butscher, San Jose; William J. Dawley, Sunnyvale; Joseph T. Loane, Pacifica; David R. Tanner, San Mateo, all of CA (US)

(73) Assignee: Lockheed Martin Missiles & Space Company, Sunnyvale, CA (US)

( * ) Notice: Under 35 U.S.C. 154(b), the term of this patent shall be extended for 0 days.

(21) Appl. No.: 08/999,651

(22) Filed: Jun. 23, 1997

Related U.S. Application Data

(63) Continuation of application No. 08/769,515, filed on Dec. 19, 1996, now abandoned.

(51) Int. Cl.[7] ..... H01Q 1/38; H01Q 19/12; H01Q 15/06

(52) U.S. Cl. ..... 343/754; 343/770; 343/912

(58) Field of Search ..... 343/754, 912, 343/767, 770; H01Q 1/38, 19/12, 15/06

(56) References Cited

U.S. PATENT DOCUMENTS

| | | | | |
|---|---|---|---|---|
| 2,960,693 | | 11/1960 | Fry | 343/765 |
| 4,684,952 | * | 8/1987 | Munson et al. | 343/754 |
| 4,862,190 | * | 8/1989 | Palmer et al. | 343/915 |
| 5,227,808 | * | 7/1993 | David | 343/915 |
| 5,268,701 | * | 12/1993 | Smith | 343/767 |
| 5,309,165 | | 5/1994 | Segal et al. | 343/770 |
| 5,359,338 | | 10/1994 | Hatcher, Jr. et al. | 343/778 |

* cited by examiner

*Primary Examiner*—Michael C. Wimer
(74) *Attorney, Agent, or Firm*—Swidler Berlin Shereff Friedman, LLP

(57) ABSTRACT

A reflector for an antenna includes a plurality of reflector elements, each having a transmission line and an aperture at a distal end of the transmission line. Each transmission line having a length which varies in accordance with the position of each aperture relative to the antenna. The varying length of transmission creates a time delay that phases re-radiated waves.

17 Claims, 7 Drawing Sheets

LARGE INSTANTANEOUS BANDWIDTH REFLECTOR ARRAY

This application is a continuation of U.S. patent application Ser. No. 08/769,515 filed Dec. 19, 1996 (now abandoned).

FIELD OF THE INVENTION

The present invention relates generally to antenna systems and, more particularly, to flat, relatively thin broadband reflectors capable of receiving and transmitting radio frequency waves, particularly in the microwave range.

BACKGROUND OF THE INVENTION

An antenna is a conductor or system of conductors designed to radiate or intercept electromagnetic waves. While being varied in size and shape, all antennas are made up of conducting material and require a feed system to extract or accept energy. An antenna converts guided electric waves into electromagnetic waves in free space. A matching device of some sort is generally employed to facilitate this conversion, and a transmission line is often used to efficiently guide the electric waves from the transmitter to the antenna.

Antennas employing parabolic reflectors have been in widespread use for many years to direct the wave front to the receiver in phase. This is accomplished by the geometry of the parabolic reflector which provides a constant path length from any point on the reference plane to the receiver. Basically, waves arriving at the reflector surface in phase are reflected to the focal point along equi-distant paths, thereby arriving at the focal point in phase.

Because of the resulting high gain, the constant path length parabolic antenna is popular for use at many wavelengths, including microwave and visible. For a satellite receiving station, the diameter of the parabola is a function of the merit factor, G/T, linking the gain G of the parabola and the overall noise temperature (T) desired on the station. Generally, the diameter of the parabola defines its beam width. At the same time, the beam width determines the sensitivity of the system to interference coming from satellites adjacent to the satellite aimed at, which limits the ability to reduce the diameter of the parabola.

The packaging, deployment, size and pointing difficulties for employing a conventional parabola make it impractical for use in space as well as in other applications.

Flat array antennas are being used to overcome the limits imposed by parabolic designs. In an array antenna, an array of receiving elements are arranged in parallel, and the gain is a function of the area of the antenna. However, for flat array antennas employing summing systems, efficiency decreases as area increases because of the loss generated in the summing systems.

An example of a flat array antenna having a summing system is described in U.S. Pat. No. 5,227,808 to Davis. The antenna array is constructed in sub-arrays which are supported in a stacked and folded condition and then expanded when deployed in space. Each sub-array includes a plurality of tapered notch antenna elements, each of which is fed by a section of slotline, which is in turn fed by a coplanar waveguide.

While electronic phasing devices used in conjunction with flat array antennas might be generally workable, they tend to be complicated, fragile and difficult to assemble.

A need exists for antennas having in excess of 10% bandwidth for high quality data transmission, which are light weight for ease of rapid pointing and are capable of high gain, while at the same time being physically thin for ease of storage and deployment and low blockage.

SUMMARY OF THE INVENTION

An object of the present invention is to provide a reflector array for an antenna in which the low loss and large bandwidth are simultaneously achieved.

Another object of the present invention is to provide a reflector array in which operation and collimating of the radio frequency (RF) energy is achieved by the phasing of the RF energy that is re-radiated by each aperture of the array when the entire reflector surface is illuminated by the feed line.

Another object of the present invention is to provide a time delay in the elements of the array so that reflected, or transmitted, waves are in phase without the need for electronic summing devices or other electronic means.

Another object of the present invention is to provide a reflector array which is relatively simple in construction and cost effective to produce.

Still another object of the invention is to provide a reflector array which can be folded and stowed in a compact state for subsequent deployment with relative ease in an expanded state.

Yet another object of the invention is to provide very high antenna gain and large frequency bandwidth, such as greater than 45 db gain, in the physically thinnest structure possible that does not exceed, for example, two and one half inches.

These and other objects are met by providing a reflector for an antenna which includes a plurality of reflector elements, each having a transmission line and an aperture at a distal end of the transmission line, each transmission line having a length which varies in accordance with the position of each aperture relative to the antenna.

Other objects, advantages and salient features of the invention will become apparent from the following detailed description, which taken in conjunction with the annexed drawings, discloses preferred embodiments of the invention.

DETAILED DESCRIPTION OF THE INVENTION

Figure 1:
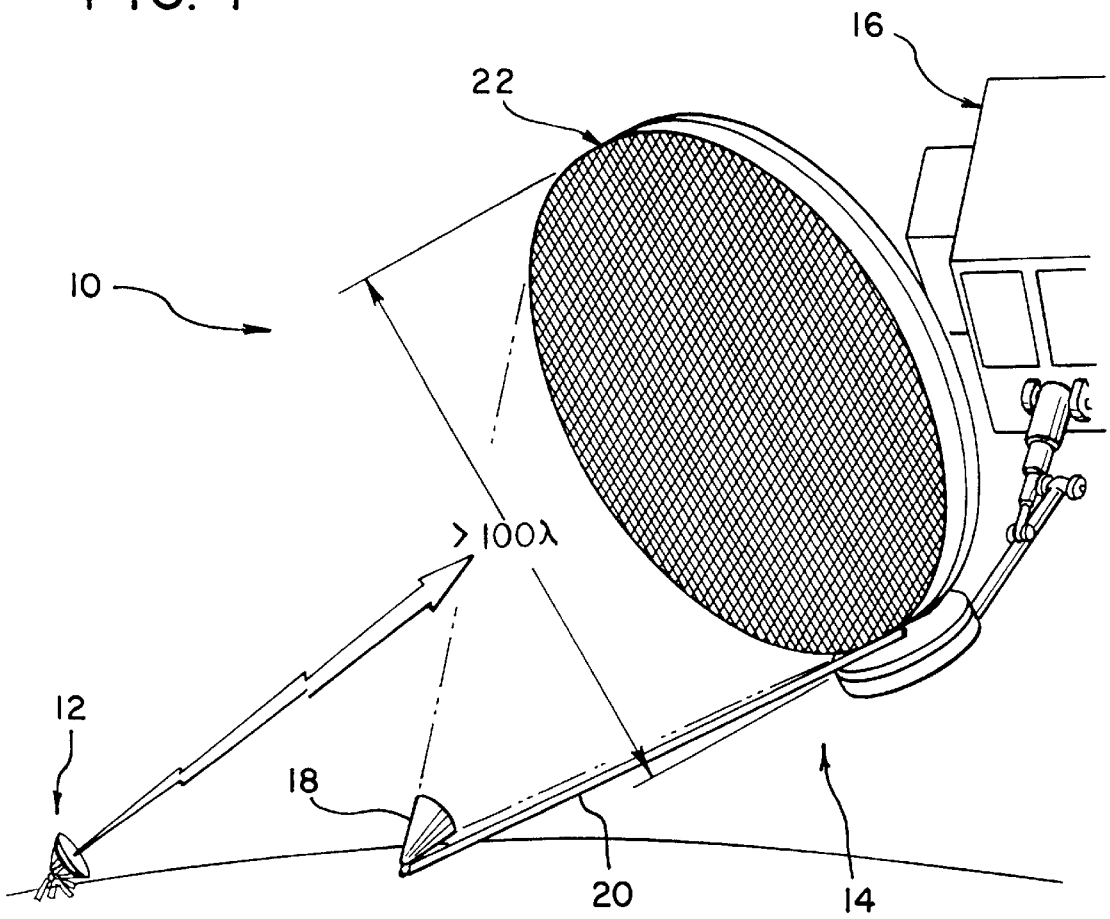
FIG. 1 is a perspective view of an antenna system of the present invention shown in a satellite application.
Figure 2:
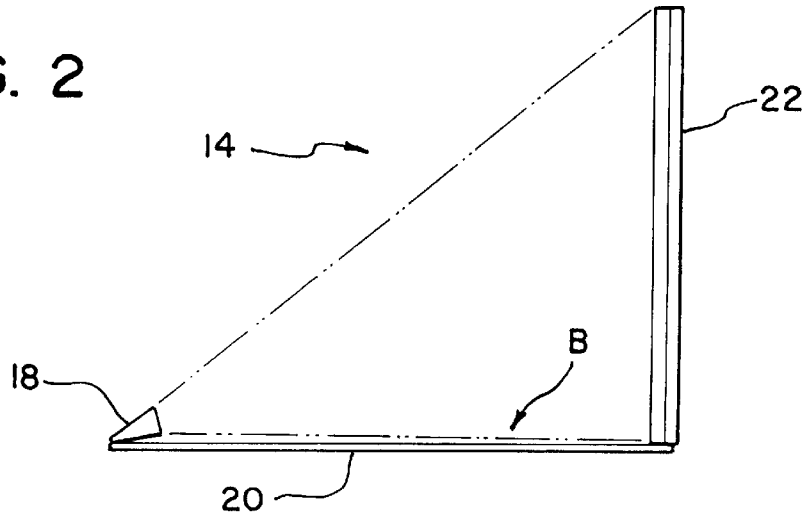
FIG. 2 is a side elevational view of the satellite reflector and offset feed antenna.

Referring to FIGS. 1 and 2, a satellite communication system 10 includes a ground based antenna system 12 and a space based antenna system 14 mounted on the satellite.

The space based antenna system 16 includes a feed antenna 18 fixedly mounted on the distal end of a boom 20 which extends outwardly from a reflector 22. As seen in FIG. 2, the boom 20 is mounted at its proximal end to the perimeter of the reflector 22 and is disposed at a right angle thereto, although other dispositions including central mounting could be used.

Figure 3:
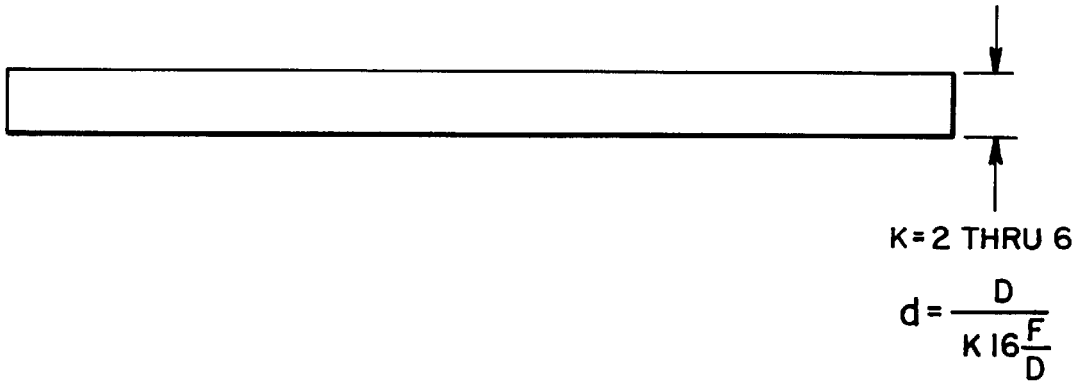
FIG. 3 is a side elevational view of the reflector of FIG. 2.
Figure 4:
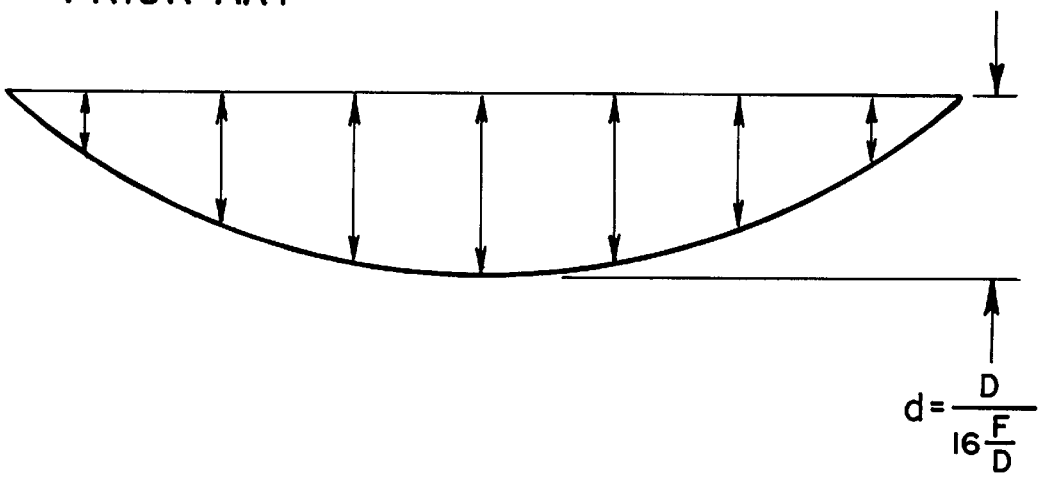
FIG. 4 PRIOR ART
FIG. 4 is a schematic view, in vertical section, of a prior art parabolic reflector.

The reflector 22 is flat and relatively thin, particularly in comparison to parabolic reflectors of comparable ratio of focal length to diameter (F/D). This is demonstrated by comparing FIGS. 3 and 4, which respectively illustrates the profile of the flat reflector 22 of FIGS. 1 and 2 and the profile of a typical parabolic reflector, where depth "d" is determined by the formula $$d = \frac{D}{16\ F/D}$$

This relationship means that, for example, a practical metal parabola would have to have a focal distance to its feed antenna that would be in the order of fifty feet for a seven foot parabola.

Figure 5:
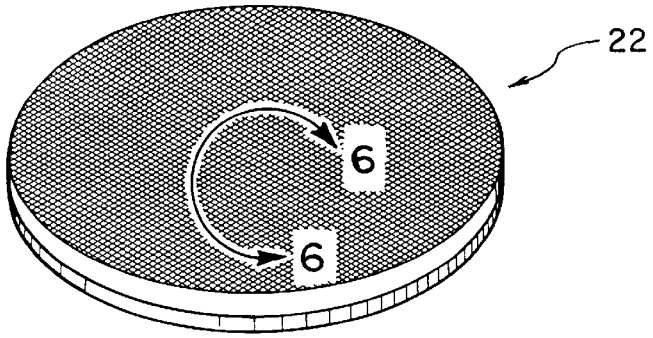
FIG. 5 is a perspective view of a reflector according to one embodiment of the present invention.
Figure 6:
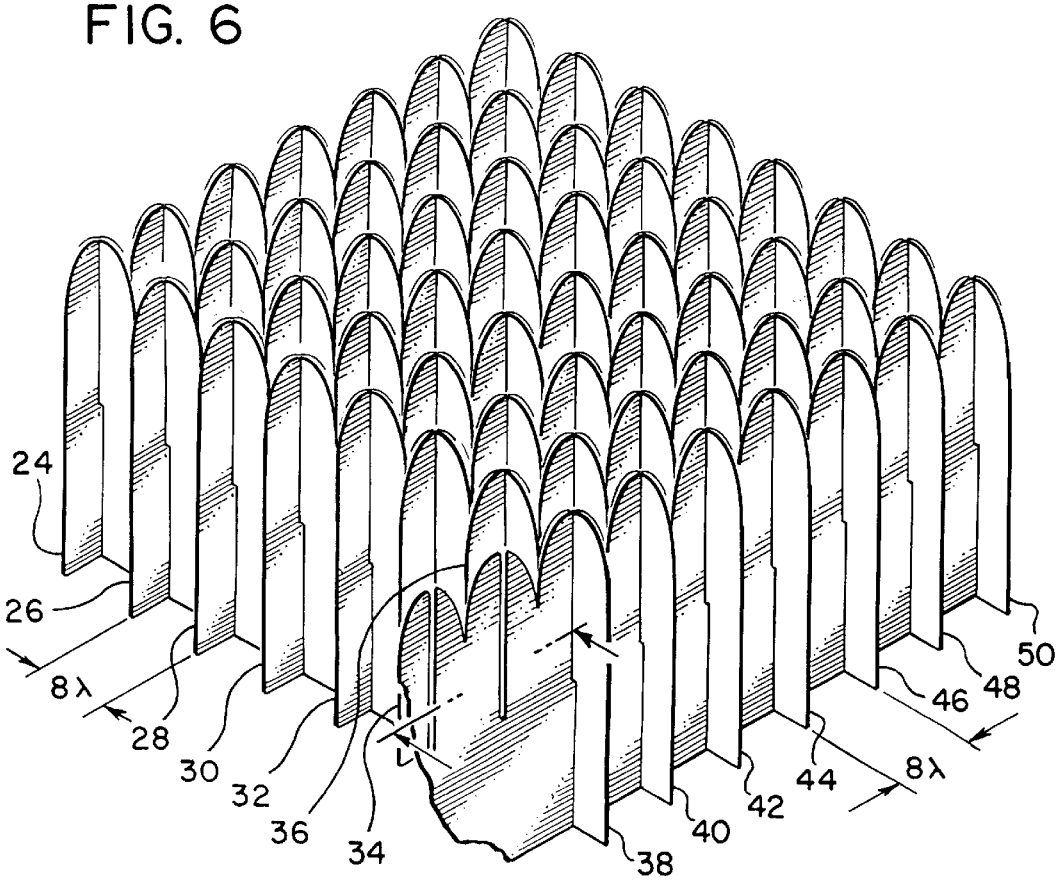
FIG. 6 is an enlarged, partial perspective view illustrating the array elements which comprise the reflector of FIG. 6, taken from the region 6—6 of FIG. 5.

Referring to FIGS. 5 and 6, the reflector 22 is made of a series of interfitting reflector members, of which members 24, 26, 28, 30, 32, 34, 36, and members 38, 40, 42, 44, 46, 48, 50 are shown in FIG. 6. Each member is provided with a plurality of spaced apart complementary interfit slots, which will be described in more detail below, which permit and facilitate the interconnection of all reflector members in an "eggcrate" fashion.

Figure 7:
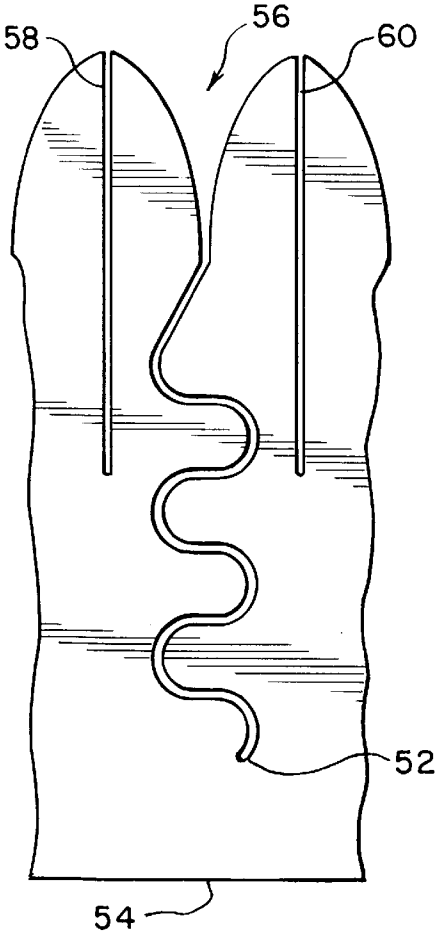
FIGS. 7–9 are enlarged, partial side elevational views showing in sequence array elements having progressively shorter feed lines, and showing a preferred meandering feed line pattern.

While parabolic reflectors use geometry to cause reflected waves to arrive at the feed antenna in phase, the present invention employs a time delay imparted by using varying length transmission lines formed in the reflector members. Referring to FIG. 7, a transmission line 52 formed in a metallic reflector member 54 acts as a broadband, endfire aperture having a mouth 56 that is tapered to achieve a broad bandwidth operation capability. The transmission line 52 is in a sinusoidal or meandering pattern, and at the upper end portion is flanked by interconnect slots 58 and 60 which interfit with slots formed in the reflector members that are to be interfitted therewith. In the embodiment of FIG. 6, the slots are spaced 0.8 $\lambda$ apart.

Figure 8:
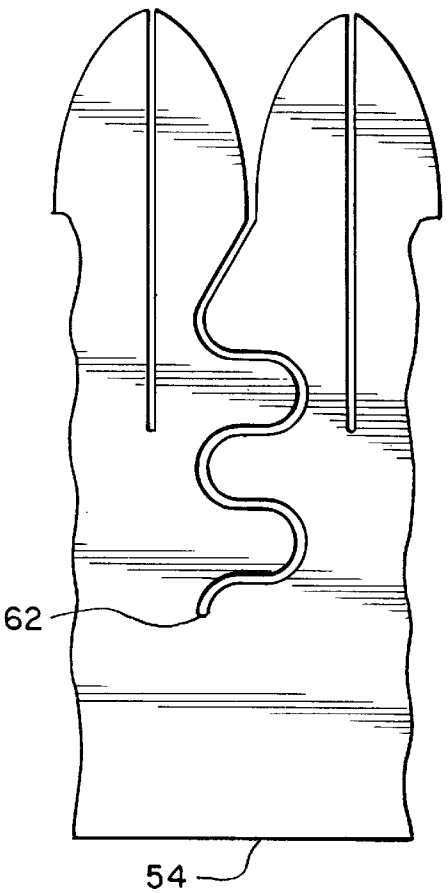
Figure 9:
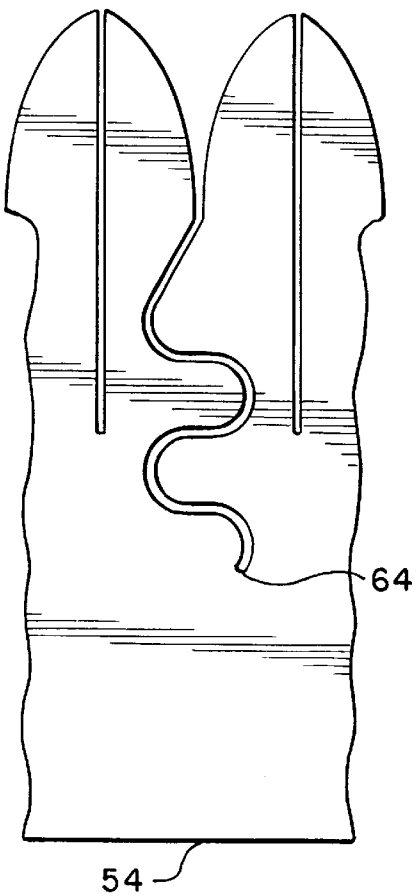

FIGS. 8 and 9 show transmission lines that may be formed on the same reflector member 54, but at different radial locations. The transmission line 60 of FIG. 8 has a shorter length than the transmission line 52, and the transmission line 62 of FIG. 9 is still shorter, and the transmission lines (not shown) disposed between transmission lines 52, 60 and 62 can be progressively shorter.

The varying lengths of transmission lines introduce a time delay in the re-radiation of the incident wave, for example, that ensures that the reflected waves arrive at the feed antenna in phase. Referring to FIG. 2, a wave reflected along line "A" towards the feed antenna 18 has more distance to traverse than a wave reflected along line "B." Without more, waves a and B, which were radiated from the ground based antenna in phase and arrive at the reflector 22 in phase, would be re-radiated to the feed antenna 18 out of phase. However, by arranging the apertures such that the shorter transmission lines are at the greatest distance from the antenna 18 (the point where a reflects from the reflector 22) and the longest transmission lines are at the shortest distance from the antenna (where B reflects from the antenna 18), the waves arrive all in phase.

Figure 10:
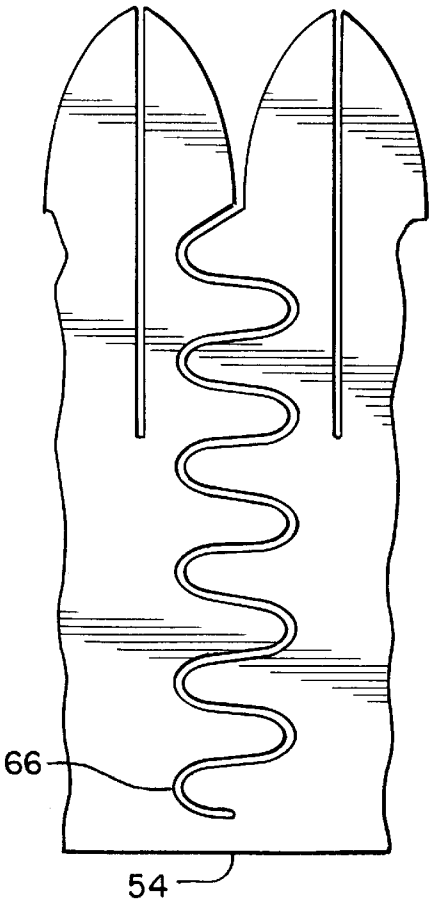
FIG. 10 is an enlarged, partial side elevational view of an array element having a longer feed line, with a steeper sinusoidal pattern than those of FIGS. 7–9.

The meandering pattern shown in FIGS. 7–9 is preferred since it allows for greater lengths in a relatively confined amount of space. FIG. 10 shows a still further enhancement of the length of the transmission line 66 by the use of a steeper or deeper curve in the sinusoidal pattern.

Figure 12:
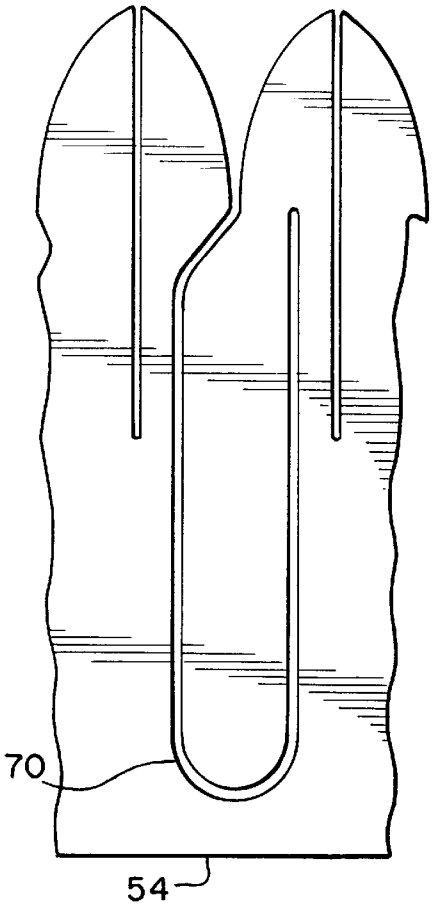
FIG. 12 is an enlarged, vertical, longitudinal cross-sectional view of a gate valve according to a preferred embodiment of the present invention, and showing the valve element in the closed position.
Figure 11:
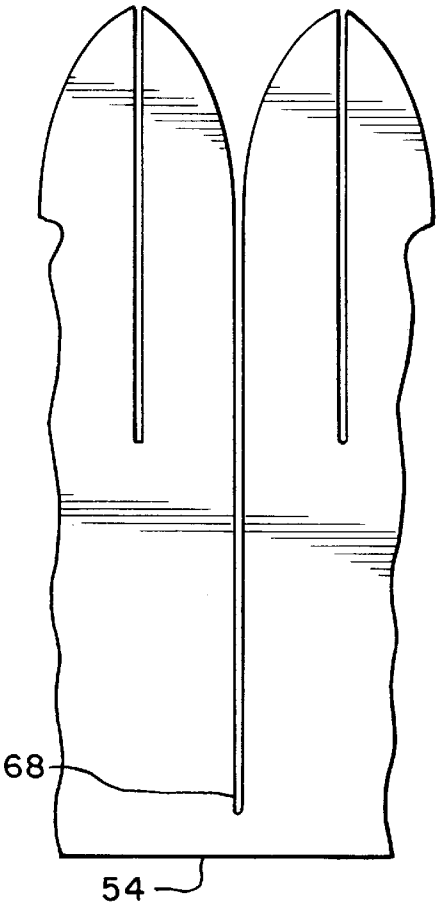
FIG. 11 is an enlarged, partial side elevational view of an array element having a straight feed line.

FIG. 11 shows an alternative embodiment, in which the transmission line 68 is a straight line. In this embodiment, the length of the line would vary according to radial position on the reflector or distance from the feed antenna. FIG. 12 is a variation of the FIG. 11 embodiment, in which the transmission line 70 doubles back for enhanced length.

Figure 13:
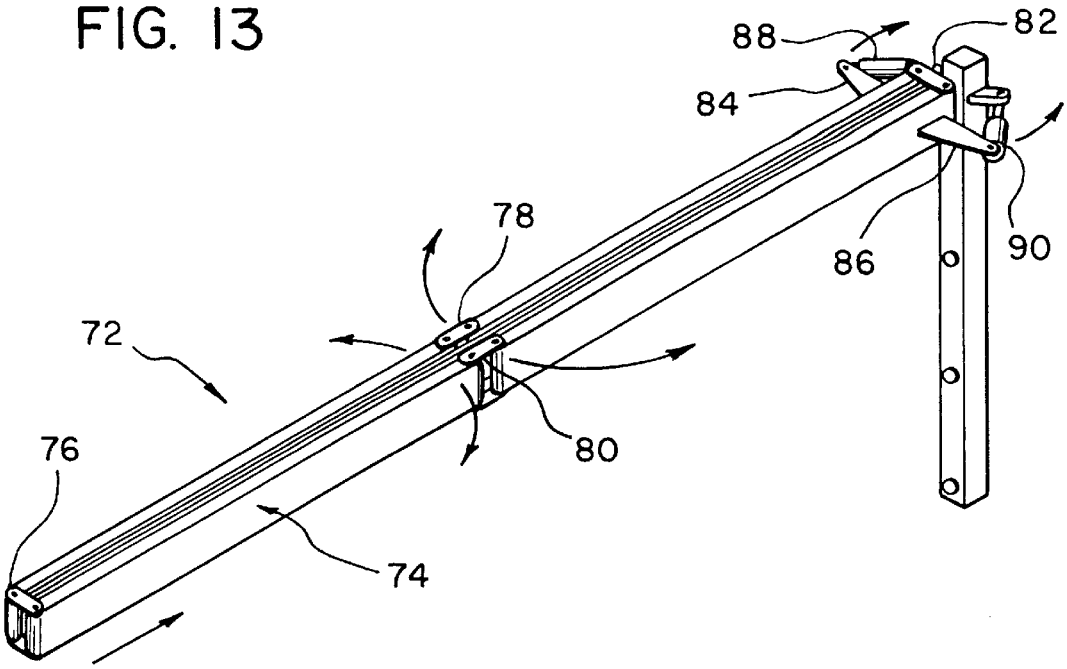
FIG. 13 is a perspective view of a reflector panel folded prior to deployment.
Figure 14:
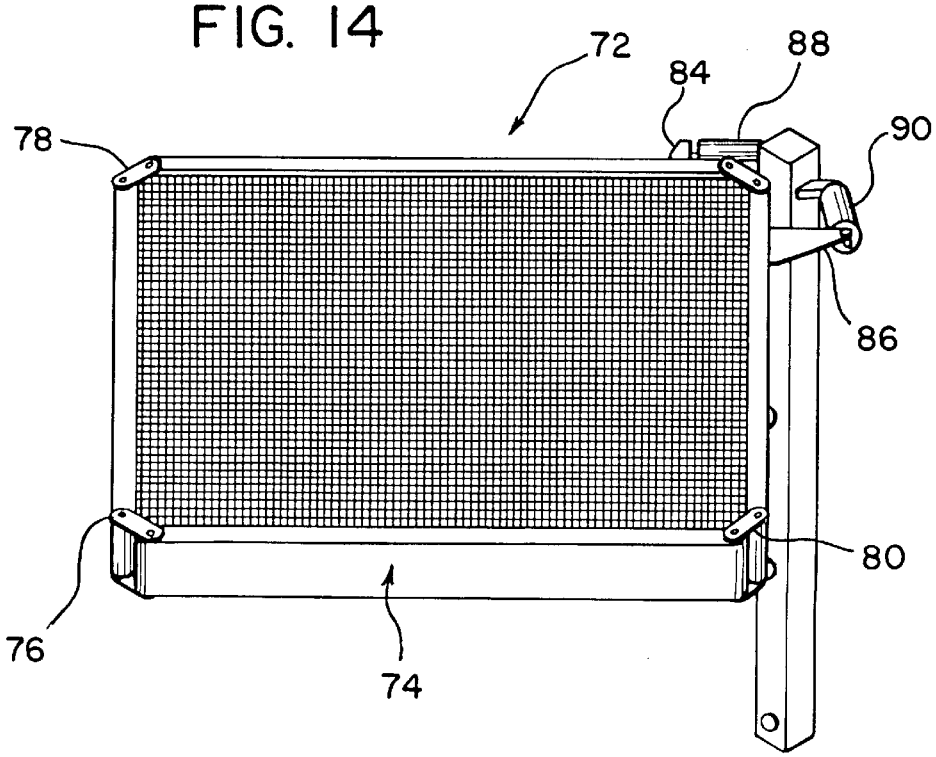
FIG. 14 is a perspective view of the reflector panel in a deployed state.

Because of the way in which the members interfit, it is possible to assemble reflectors that can be stowed in a relatively confined volume, and then deployed when ready for use. This is particularly relevant for space applications, where payload space for launch vehicles is very limited. Referring to FIGS. 13 and 14, a rectangular reflector 72 is stowed in a collapsed position. The frame 74 of the reflector 72 is provided with links 76, 78, 80, and 82 which permit unfolding of the reflector 72 when arms 84 and 86 are actuated by motors 88 and 90.

Figure 15:
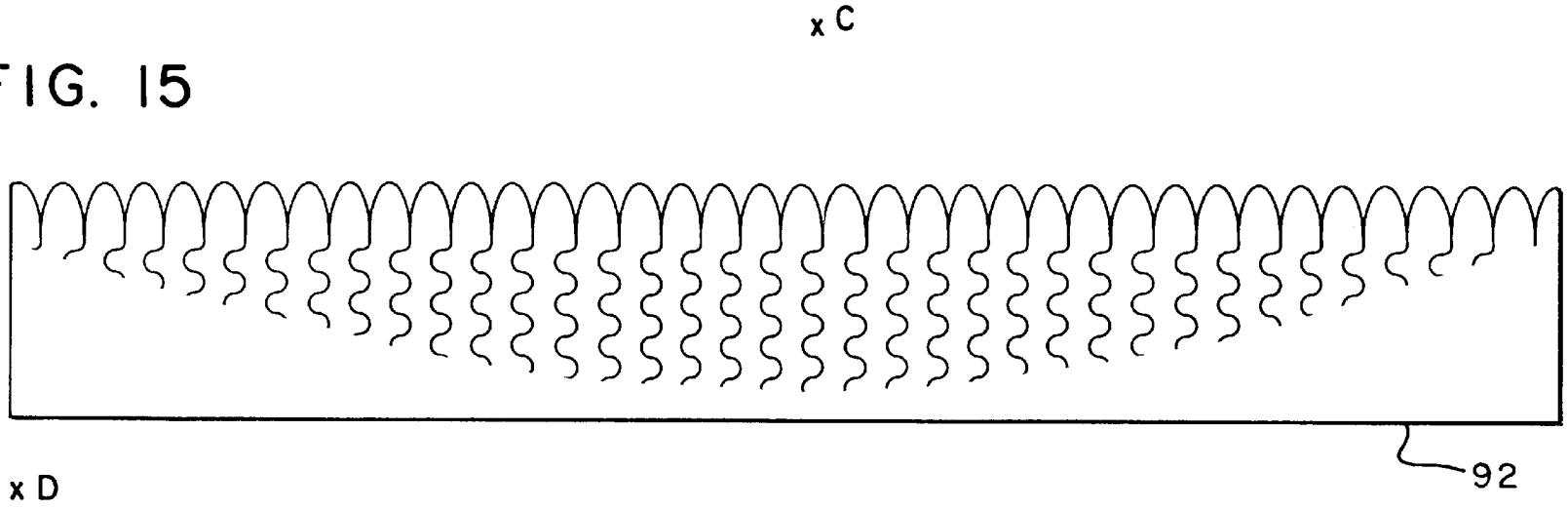
FIG. 15 is a side elevational view of a single element of a reflector array, and showing a slot line pattern for a centrally located feed antenna.

Referring to FIG. 15, a reflector member 92 has a plurality of transmission lines formed therein, each having a tapered mouth at the reflection side of the member. As seen, the transmission lines are of greatest length in the middle of the member 92 and become progressively shorter towards the outer ends. This would be appropriate for an antenna system in which the feed antenna was centrally located, given rise to a focal point "C" where the feed antenna would be located. As is evident, the outer transmission lines have less delay built in by virtue of the shorter transmission lines, so that the reflected waves would arrive at C in phase.

Figure 16:
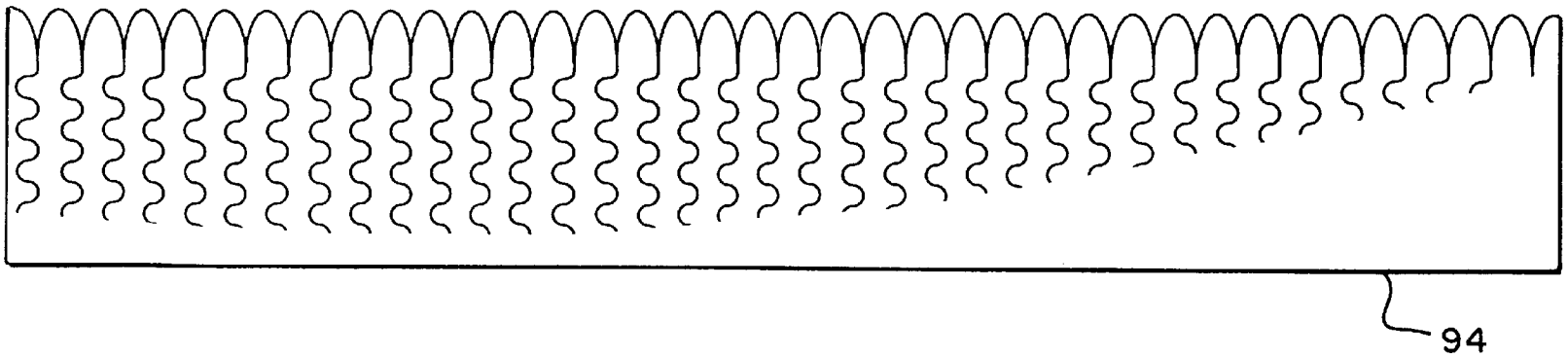
FIG. 16 is a side elevational view of a single element of a reflector array, and showing a slot line pattern for a perimeter located feed antenna.

FIG. 16 is similar to FIG. 15, except that the member 94 has transmission lines formed therein that are progressively shorter from one end to the other. This would be appropriate for a feed antenna mounted on the perimeter, as in the FIG. 1 embodiment, such that the focal point "D" would correspond to the location of the feed antenna. Since the opposite side would require the longest distance to traverse, the transmission lines on this side would be shorter.

To obtain the largest bandwidth, the transmission line time delays (length of lines) for all the reflected waves from the feed antenna should be adjusted to be equal after they pass through the reflector apertures and down the transmission line and are reflected back out to the radiating apertures.

The antenna system described above can operate in the transmit and receive modes. In either case, phasing is accomplished by a time delay imparted by the length of the transmission lines. Moreover, the transmission lines are of general dimensions to act as wave guides, but they are not limited to sinusoidal or straight line patterns. The importance of geometry lies in the overall length of each line, and the varying length between adjacent lines which assures that all waves are re-reflected in phase. The transmission lines can be slow wave, thin structures such as corrugated coplanar waveguides or slotlines.

As a result of using the time delayed phasing, reflectors that are very light weight can be constructed. For example, the weight of a seven foot by seven foot reflector for 60 GHz transmission and reception using the eggcrate construction with conducting walls of copper (0.005 inch thick) would be approximately five pounds not including the weight of the dielectric face sheet radomes. Also, since this structure is made of metal, it can conduct heat to cool devices that are attached and produce heat such as RF power amplifiers. This may be particularly suitable for instances when the reflector is made active and driven by individual sources.

The transmission line patterns can be formed using standard photolithographic techniques, which are particularly useful when considering that a reflector array of the present invention could use 20,000 apertures or more. In any event, operation and collimating of the RF energy is achieved by the phasing of the RF energy that is re-radiated by each aperture of the reflector when the entire reflector surface is illuminated by the feed antenna. Similarly, if receiving a RF transmission, the reflector reflects the waves to the feed antenna in phase.

While advantageous embodiments have been chosen to illustrate the invention, it will be understood by those skilled in the art that various changes and modifications can be made therein without departing from the scope of the invention as defined in the appended claims.

What is claimed is:

1. A reflector for an antenna comprising:

a plurality of planar reflector elements arranged in parallel, each reflector element having a plurality of transmission lines formed in the plane of that reflector element, each transmission line having an aperture at a distal end thereof, the plurality of planar reflector elements being collapsible, each transmission line having a length which varies in accordance with the position of each aperture relative to the antenna.

2. A reflector according to claim 1, wherein the transmission lines follow a meandering path and the apertures are flared.

3. A reflector according to claim 1, wherein the transmission lines have substantially linear segments and the apertures are flared.

4. A reflector according to claim 1, wherein the plurality of reflector elements are provided with complementary and interfitting slots.

5. A reflector according to claim 1, further comprising a frame having pivotally interconnected frame elements that are movable from a linear disposition to a rectangular disposition via actuation means.

6. A reflector according to claim 5, wherein the actuation means include at least one motor.

7. A reflector according to claim 1, wherein the apertures are approximately 0.8 $\lambda$ apart, and the reflector is at least 100 $\lambda$ in diameter.

8. A reflector according to claim 1, wherein each reflector element is made of a dielectric material coated with a metallic material.

9. A reflector according to claim 1, wherein each transmission line is progressively shorter as the distance of the transmission line from the antenna increases.

10. A reflector according to claim 1, wherein the apertures define a substantially flat reflection surface.

11. An antenna system, comprising:

a feed antenna; and a flat reflector made of a plurality of interfitting planar reflector elements arranged in parallel, each planar reflector element having a transmission line formed in the plane of that reflector element and an aperture at a distal end of the transmission line, each transmission line having a length which varies in accordance with the position of each aperture relative to the feed antenna, the apertures defining a reflection surface, the plurality of interfitting planar reflector elements being collapsible; and means for supporting the feed antenna in spaced relation to the reflection surface of the reflector.

12. An antenna system according to claim 11, wherein the transmission lines follow a meandering path and the apertures are flared.

13. An antenna system according to claim 11, wherein the transmission lines have substantially linear segments and the apertures are flared.

14. An antenna system according to claim 11, wherein the plurality of reflector elements are provided with complementary and interfitting slots.

15. An antenna system according to claim 11, further comprising a frame having pivotally interconnected frame elements that are movable from a linear disposition to a rectangular disposition via actuation means.

16. An antenna system according to claim 15, wherein the actuation means include at least one motor.

17. An antenna system according to claim 11, wherein the apertures are approximately 0.8 $\lambda$ apart, and the reflector is at least 100 $\lambda$ in diameter.

* * * * *